US006995756B2

(12) United States Patent
Willis

(10) Patent No.: US 6,995,756 B2
(45) Date of Patent: Feb. 7, 2006

(54) METHODS AND APPARATUS FOR DRIVING PIXELS IN A MICRODISPLAY

(75) Inventor: Thomas E. Willis, Mountain View, CA (US)

(73) Assignee: Intel Corporation, Santa Clara, CA (US)

( * ) Notice: Subject to any disclaimer, the term of this patent is extended or adjusted under 35 U.S.C. 154(b) by 392 days.

(21) Appl. No.: 10/403,144

(22) Filed: Mar. 31, 2003

(65) Prior Publication Data

US 2004/0189561 A1 Sep. 30, 2004

(51) Int. Cl.
*G09G 5/00* (2006.01)

(52) U.S. Cl. ..... 345/204; 345/98; 345/100; 345/691

(58) Field of Classification Search ..... 345/87, 345/89, 98–100, 204, 690, 691
See application file for complete search history.

(56) References Cited

U.S. PATENT DOCUMENTS

| | | | | |
|---|---|---|---|---|
| 5,317,401 | A * | 5/1994 | Dupont et al. | 345/98 |
| 6,429,858 | B1 * | 8/2002 | Janssen et al. | 345/204 |
| 2002/0063728 | A1 * | 5/2002 | Stevens | 345/690 |
| 2003/0107541 | A1 * | 6/2003 | Naiki | 345/87 |

OTHER PUBLICATIONS

Blalock, Travis N. et al., "True Color 1024×768 Microdisplay with Analog In-Pixel Pulsewidth Modulation and Retinal Averaging Offset Correction", IEEE Journal of Solid-State Circuits, vol. 36, No. 5, May 2001. pp. 838-845.

* cited by examiner

*Primary Examiner*—Regina Liang
(74) *Attorney, Agent, or Firm*—Buckley Maschoff & Talwalkar LLC

(57) ABSTRACT

A first pixel of a pixel array of a microdisplay is driven with a first pulse having a duration determined on the basis of a value loaded into a counter. A second pixel of the pixel array is driven with a second pulse having a duration determined on the basis of (a) the value loaded into the counter and (b) a value stored in a register.

4 Claims, 6 Drawing Sheets

METHODS AND APPARATUS FOR DRIVING PIXELS IN A MICRODISPLAY

BACKGROUND

Spatial light modulators (SLMS) come in various forms including microdisplays. Some types of microdisplay are formed on a silicon substrate. Such a microdisplay may include a two-dimensional array of pixels on the silicon substrate with liquid crystal material above the pixel array. Each pixel is driven by electronics formed on the substrate. The space required for each pixel may depend in part on the amount of space occupied by the pixel-driving electronics. If the complexity of the pixel-driving electronics can be reduced, then pixels can be made smaller, and a higher-resolution display can be achieved.

DETAILED DESCRIPTION

Figure 1:
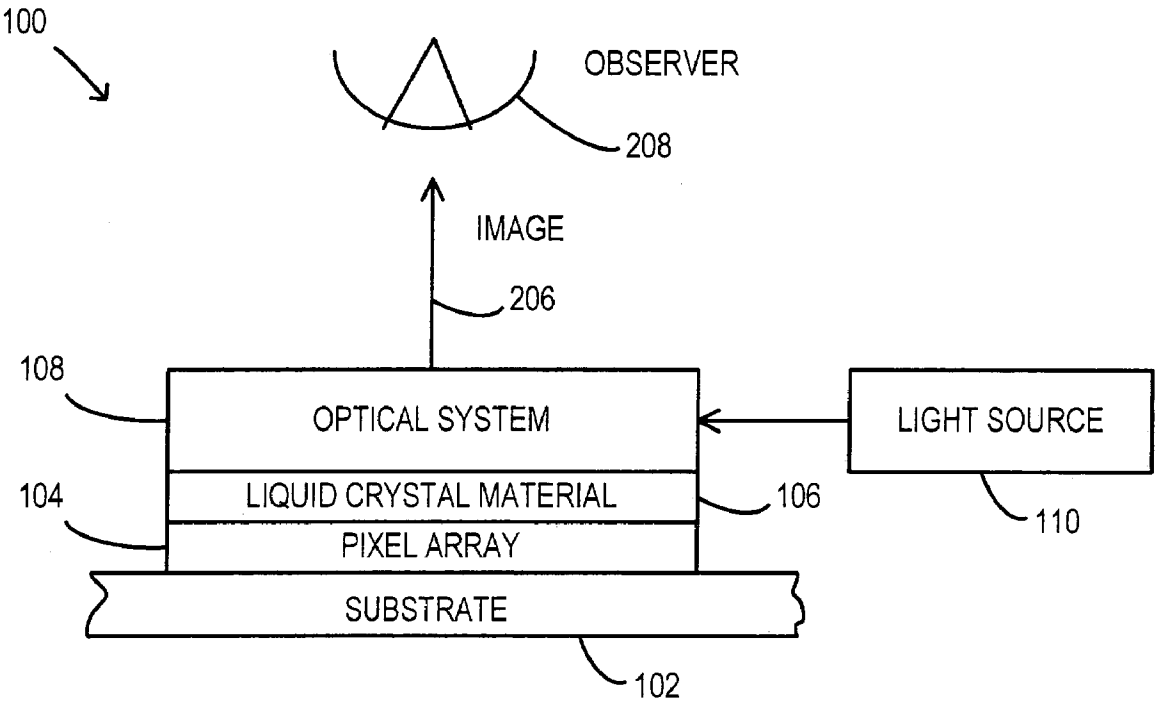
FIG. 1 is a schematic side cross-sectional view of a microdisplay according to some embodiments.

FIG. 1 is a schematic side cross-sectional view of a display device 100 according to some embodiments. The display device 100 may be formed on a silicon substrate 102, and includes a two-dimensional pixel array 104 formed on the substrate 102. The pixel array 104 includes a plurality of pixels, which are not separately shown in the drawing. In some embodiments the pixel array may have dimensions corresponding to hundreds or more pixels on a side. Driving electronics for the pixels are also not shown separately in FIG. 1 from the substrate 102 and the pixel array 104, but will be described further below.

A liquid crystal material 106, which may be provided in accordance with conventional practices, is associated with the pixel array 104. The display device 100 also includes an optical system 108, which is associated with the liquid crystal material 106, and a light source 110 which emits light into the optical system 108. The optical system 108 and the light source 110 may both be provided in accordance with conventional practices. In some embodiments the light source 110 may include a source of white light and a color wheel, which are not separately shown. In other embodiments the light source 110 may include red, green and blue light emitting diodes (not separately shown).

Figure 2:
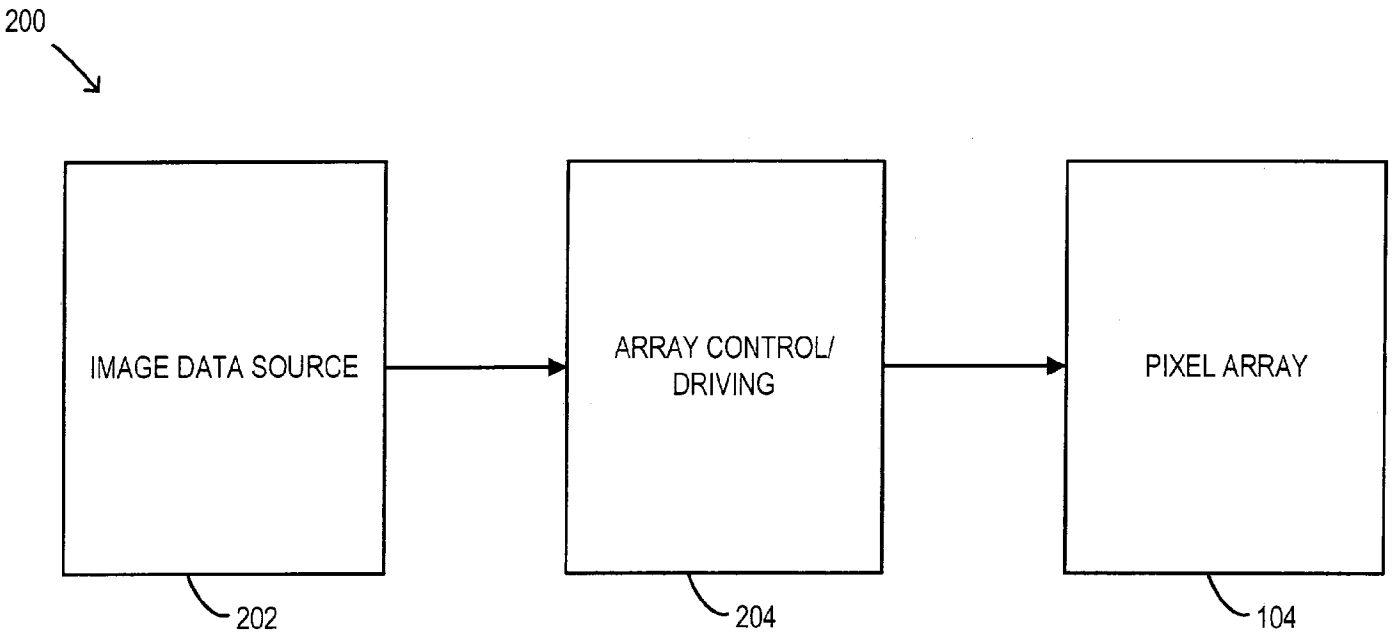
FIG. 2 is a block diagram that illustrates some aspects of a device that includes the microdisplay of FIG. 1.

FIG. 2 is a block diagram that illustrates aspects of a device 200 that may include the display device 100 of FIG. 1. The device 200 may be, for example, a handheld game device, a digital camera, a cellular telephone, a personal digital assistant (PDA) or another type of computing device.

The device 200 may include an image data source 202. The image data source 202 may be, for example, the image-capture portion of a camera, a receiver that receives image data transmitted from another device, a storage medium such as a CD-ROM or a DVD, or the image-data-generating components of a game device.

The device 200 also includes electronic components 204 that handle control and driving of the pixel array 104. The array control and driving components 204 receive frames of digital image data from the image data source 202. The array control and driving components 204 may translate the image data from the image data source 202 into suitable values for driving each pixel. The pixel values may be buffered in the array control and driving components 204 and may be converted into signals for directly driving the pixels of the pixel array 104. In some embodiments, the image data from the image data source 202 may be mapped in a non-linear fashion into pixel driving values to compensate for non-linear characteristics of the liquid crystal material 106 and for non-linearity of human visual perception. For example, because the human visual system is highly sensitive to low levels of light and is relatively insensitive to variations in high levels of light, a non-linear mapping of the image data to the pixel-driving values may. provide for relatively high intensity resolution for dark pixels in an image frame, and relatively low intensity resolution for bright pixels in the image frame.

In some embodiments, each image frame period may be divided into three sub-periods, each of which corresponds to red, green or blue components of the image frame. During the corresponding sub-period, the light source emits red, green or blue light, as appropriate, and the pixels are driven to provide a gray scale image that corresponds to the light component for the sub-period. During each sub-period, the image light 206 (FIG. 1) passes from the optical system 108 to the observer 208. The sub-periods are brief enough and near enough to each other in time to allow for retinal averaging to form a composite color image from the separate red, green and blue images provided in the respective sub-periods.

The respective pixel values for each pixel in the gray scale images are applied to the pixels by pulse width modulation. The display device 100 may operate such that the brighter pixels in the gray scale image are actuated for longer portions of the sub-period when driven with longer pulse widths, and darker pixels in the gray scale image are actuated for shorter portions of the sub-period when driven with shorter pulse widths. Alternatively, the liquid crystal material 106 may be such that the pulses turn off the pixels, in which case longer pulse widths may be applied to darker pixels and shorter pulse widths may be applied to brighter pixels.

Figure 3:
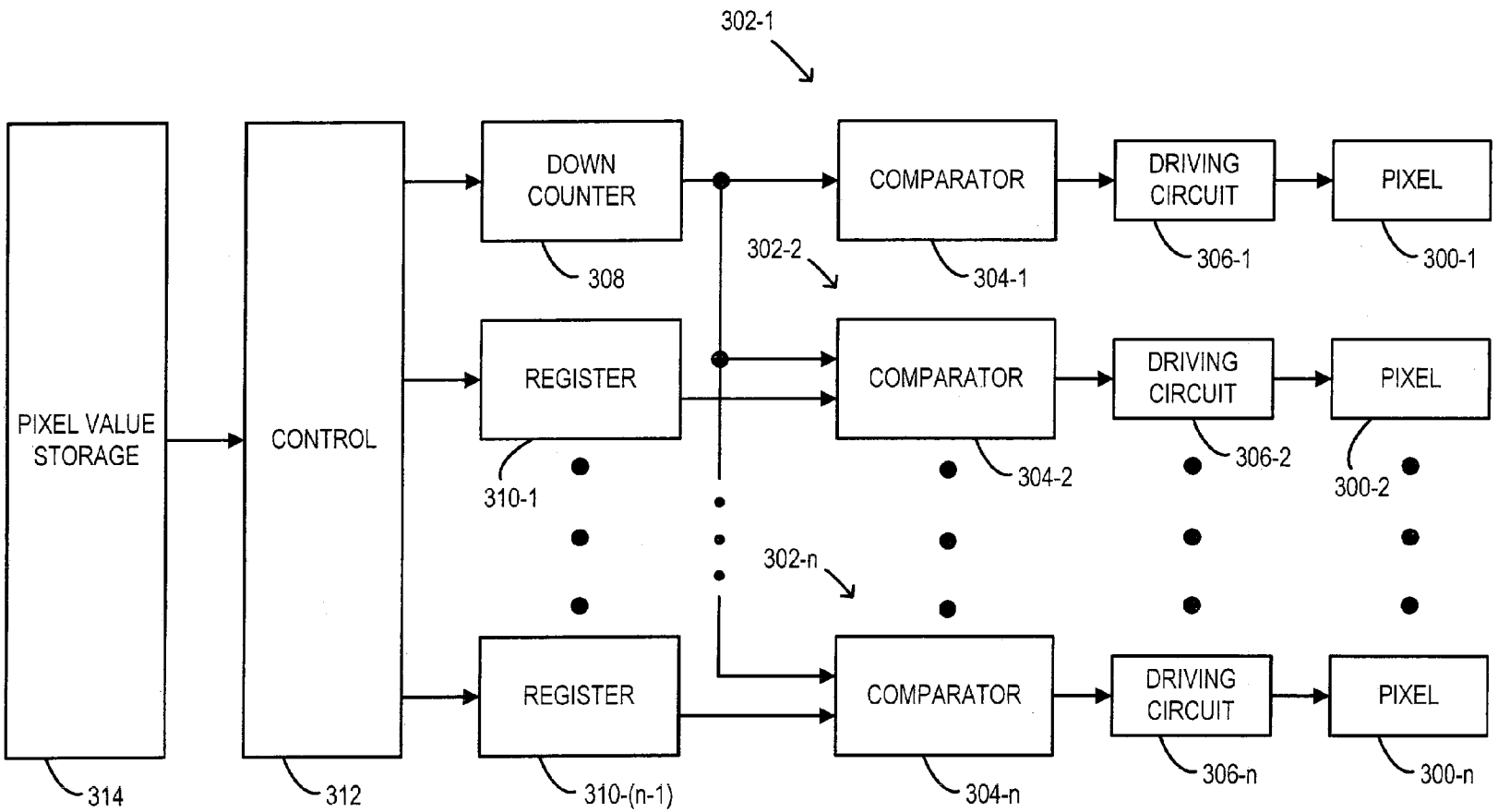
FIG. 3 is a more detailed block diagram that illustrates a pixel driving arrangement according to some embodiments.

FIG. 3 is a more detailed block diagram that shows aspects of the array control and driving components 204 of FIG. 2 according to some embodiments. In FIG. 3, pixels 300 are shown. The pixels 300 may be a subset of the pixels which make up the pixel array 104. Coupled to each pixel 300 is a respective driver 302. Each driver 302 includes a comparator 304 and a driving circuit 306. The driving circuits 306 are directly coupled to the pixels 300. Each driving circuit 306 is arranged to be in an active condition when its associated comparator 304 outputs a first logic signal and is inactive when the associated comparator 304 outputs a second logic signal. When a driving circuit 306 is in an active condition it outputs a driving signal to its associated pixel 300 so that the associated pixel 300 is actuated (on). When a driving circuit is inactive it does not output the driving signal and the associated pixel is deactuated (off).

A down counter 308 is coupled to all of the comparators 304 so as to provide a current count value of the counter as an input to the comparators 304. Thus the counter 308 is shared by all of the drivers 302.

A respective register 310 is coupled to each of the comparators 304 other than the first comparator 304-1. Each register 310 is configured to provide as an input to its associated comparator 304 a value that has been stored in the register 310. The value stored in each register 304 corresponds to a difference in the amount of time that its associated pixel 300 is to be actuated in the current sub-period relative to the amount of time that the first pixel 300-1 is to be actuated in the current sub-period. The first comparator 304-1 operates to compare the current count value of the counter 308 to zero, and outputs the first logic signal so that the associated driving circuit 306-1 is in an active condition so long as the current count value of the counter 308 exceeds zero. Each other comparator 304 operates to compare the current count value of the counter 308 to the value stored in the register 310 coupled to the comparator 304. Each comparator 304 other than the first comparator 304-1 operates to output the first logic signal so that the associated driving circuit 306 is in an active condition so long as the current count value of the counter 308 exceeds the value stored in the associated register 310. The value stored in a register 310 is positive if the associated pixel 300 is to be actuated for a shorter portion of the current sub-period than the first pixel 300-1. The value stored in a register 310 is negative if the associated pixel 300 is to be actuated for a longer portion of the current sub-period than the first pixel 300-1.

A control circuit 312 is coupled to the counter 308 and to the registers 310. The control circuit 312 operates to initialize (store an initial count value in) the counter 308 and to store suitable values in the registers at or prior to the beginning of each sub-period. The operation of the control circuit 312 is based on pixel values for the sub-period, which are stored in a pixel value storage circuit 314 that is coupled to the control circuit 312. The pixel values stored in the pixel value storage circuit 314 may be generated by suitable mapping (linear or non-linear) from image data provided by the image data source 202 (FIG. 2). Suitable circuitry to perform the mapping of image data to pixel values is not separately shown in the drawings. In some embodiments the image data may be 8 bits per color per pixel for each image frame, and each pixel value may be a 10-bit number.

In some embodiments, the control circuit may operate to initialize the counter 308 to an initial value that is the same as the pixel value for the first pixel 300-1. For each register 310, the value stored therein by the control circuit 312 may be obtained by subtracting the pixel value for the associated pixel 300 from the pixel value for the first pixel 300-1.

The drivers 302 and pixels 300 shown in FIG. 3 may be only a subset of all the pixels in the pixel array 104 and their associated drivers. Thus, the array control and driving components 204 (FIG. 2) may include additional drivers which are not shown in FIG. 3, as well as additional down counters, each of which serves a respective group of drivers, and additional registers, each of which serves a respective driver that is not driven by a one-input comparator like the comparator 304-1. The control circuit 312 and the pixel value storage circuit 314 may be arranged to serve the other counters and registers that are not shown in FIG. 3.

Figure 4:
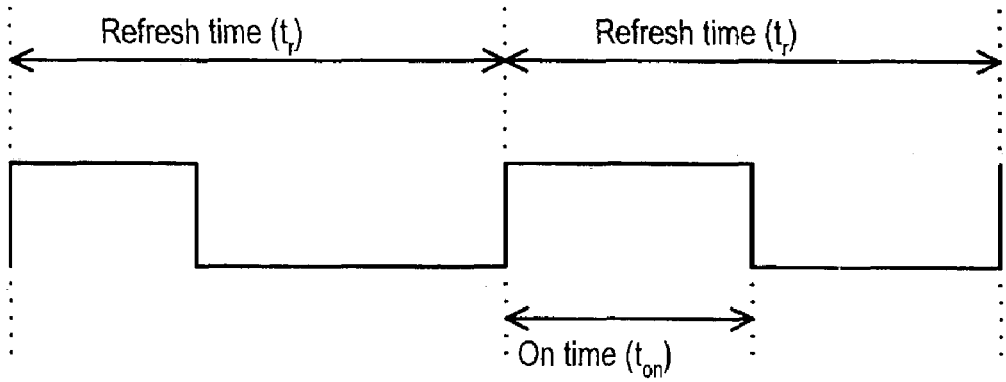
FIG. 4 is a waveform diagram that illustrates a pulse width modulation pixel-driving signal.

In operation, each pixel is driven with a respective pulse width modulation signal, as illustrated in FIG. 4. In FIG. 4, the indicated "refresh time" corresponds to the duration of a sub-period, and the portion of the sub-period during which the pixel in question is to be activated is indicated as the "on time ($t_{on}$)". It will be observed from FIG. 4 that the on time $t_{on}$ may, and typically does, vary from one refresh period to the next.

For each image frame period, a frame of image data is received by the array control and driving components 204 from the image data source 202. The image data is translated into pixel values by circuitry which is not separately shown, and the resulting pixel values are stored in the pixel value storage circuit 314. At the start of each sub-period, the control circuit 312 initializes the counter 308 with an initial value that corresponds to the pixel value for pixel 300-1. Also, the control circuit stores in each register 310 a value that is obtained by subtracting from the pixel value for pixel 300-1 the pixel value for the pixel that corresponds to the register 310.

Figure 5:
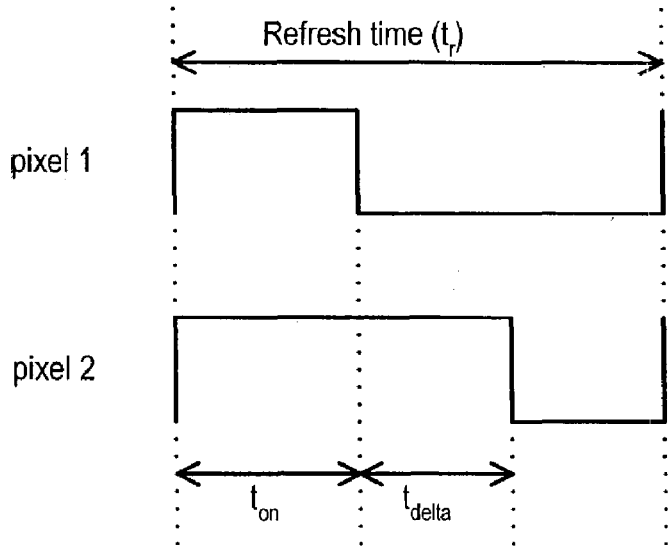
FIG. 5 is a waveform diagram that illustrates pulse width modulation driving signals for two pixels that are driven by shared hardware according to some embodiments.

To provide a simplified example, assume that pixel 300-1 is to be on in the current sub-period for a duration that corresponds to 10 clock "ticks" and that pixel 300-2 is to be on for a duration that corresponds to 20 clock "ticks". The control circuit 312 accordingly initializes the counter 308 to an initial value of "10" (corresponding to $t_{on}$ in FIG. 5). Also, the control circuit calculates the additional time that pixel 300-2 is to be on (corresponding to $t_{delta}$ in FIG. 5) as 10 and loads the value "−10" in corresponding register 310-1.

At the start of the sub-period, the light source 110 (FIG. 1) begins to supply light of the appropriate color (red, green or blue as the case may be) to the optical system 108. Assuming that pixel 300-1 is to be on for a portion of the current sub-period, then counter 308 has been initialized with a positive value and the comparator 304-1 outputs a logic signal such that the driving circuit 306-1 actuates the pixel 300-1. (If the pixel 300-1 is not to be on for a portion of the current sub-period, then the counter 308 is initialized to "0" and pixel 300-1 is never turned on during the current sub-period.) For each of the other pixels 300-2 to **300-*n* that are to be on for a portion of the current sub-period, a value equal to $-t_{delta}$ has been loaded into the corresponding register 310. The corresponding comparator 304 outputs a logic signal such that the corresponding driving circuit 306 actuates the corresponding pixel. (If a pixel, other than pixel 300-1, in the group served by the counter 308 is not to be on for a portion of the current sub-period, then the corresponding register 310 is loaded with the same value to which the counter 308** is initialized, and the pixel is never turned on during the current sub-period.)

The counter 308 counts down. The first pixel 300-1 remains on until the current counter value reaches zero, at which time the comparator 304-1 changes its output signal so that the driving circuit 306-1 becomes inactive and the first pixel 300-1 is turned off. Thus the driver 302-1 has driven the first pixel 300-1 in accordance with a pulse width that corresponds to the value initially stored in the counter 308. For the other pixels that have been turned on, each respective comparator changes its output signal to turn off the corresponding pixel when the current value of the counter 308 is equal to the value $-t_{delta}$ for the corresponding pixel. (It will be understood that $-t_{delta}$ is positive when the corresponding pixel is to be on for a shorter time than the first pixel 300-1 and is negative when the corresponding pixel is to be on for a longer time than the first pixel 300-1.) It will be recognized that each other pixel (of those turned on at all) has been driven by its respective driver 302 in accordance with a respective pulse width that is determined by the respective comparator 304 based on (a) the value initially stored in the counter 308 and (b) the value $-t_{delta}$ stored in the corresponding register.

By the end of the sub-period all pixels have been turned off. The light source 110 ceases to provide light of the type for the sub-period that is just ending and may begin immediately or after a "dark period" (not indicated in FIGS. 4 and 5) to provide light of the appropriate type for the next sub-period. The counter 308 and the registers 310 are then loaded with appropriate values based on the pixel values for the current sub-period. The pixels are again turned on for periods determined based on the pixel values for the new sub-period.

Once the three sub-periods for the current frame have taken place, a new frame of image data is used to drive the display device 100 in the same manner as just described.

In the example illustrated in FIG. 3, it is indicated that one counter is shared among three or more pixels. Alternatively, the counter may be shared by only two pixels. In theory there is no limit to the number of pixels that can share one counter.

In an alternative arrangement, the counter 308 may be replaced with an up counter. In this arrangement, the comparator 304-1 is replaced with a two-input comparator and a register is provided for the first pixel 300-1 and is coupled to the second input of the comparator. In this arrangement, the respective register for each pixel is loaded with the respective pixel value for the current sub-period and the counter is initialized to zero at the start of the sub-period. The counter counts up during the sub-period. Each pixel is turned off when the counter reaches a respective current count value that is equal to the pixel value for the pixel (which had been stored in the register associated with the pixel).

The arrangement in which a counter (either an up counter or a down counter) is shared by two, three or more pixels may be advantageous in that a respective counter need not be provided for each pixel. The register which is provided instead of the counter for the additional pixels that are sharing the counter may be less complex than the counter and may take up less space on the substrate 102. Consequently, each pixel may, on average, be provided in a smaller area on the substrate, so that pixels may be placed closer together, and greater spatial resolution of the display device may be achieved.

The registers may be implemented as any convenient type of storage device, including for example RAM or flip-flops. Alternatively, the registers may be implemented as analog storage devices such as capacitors.

Figure 6:
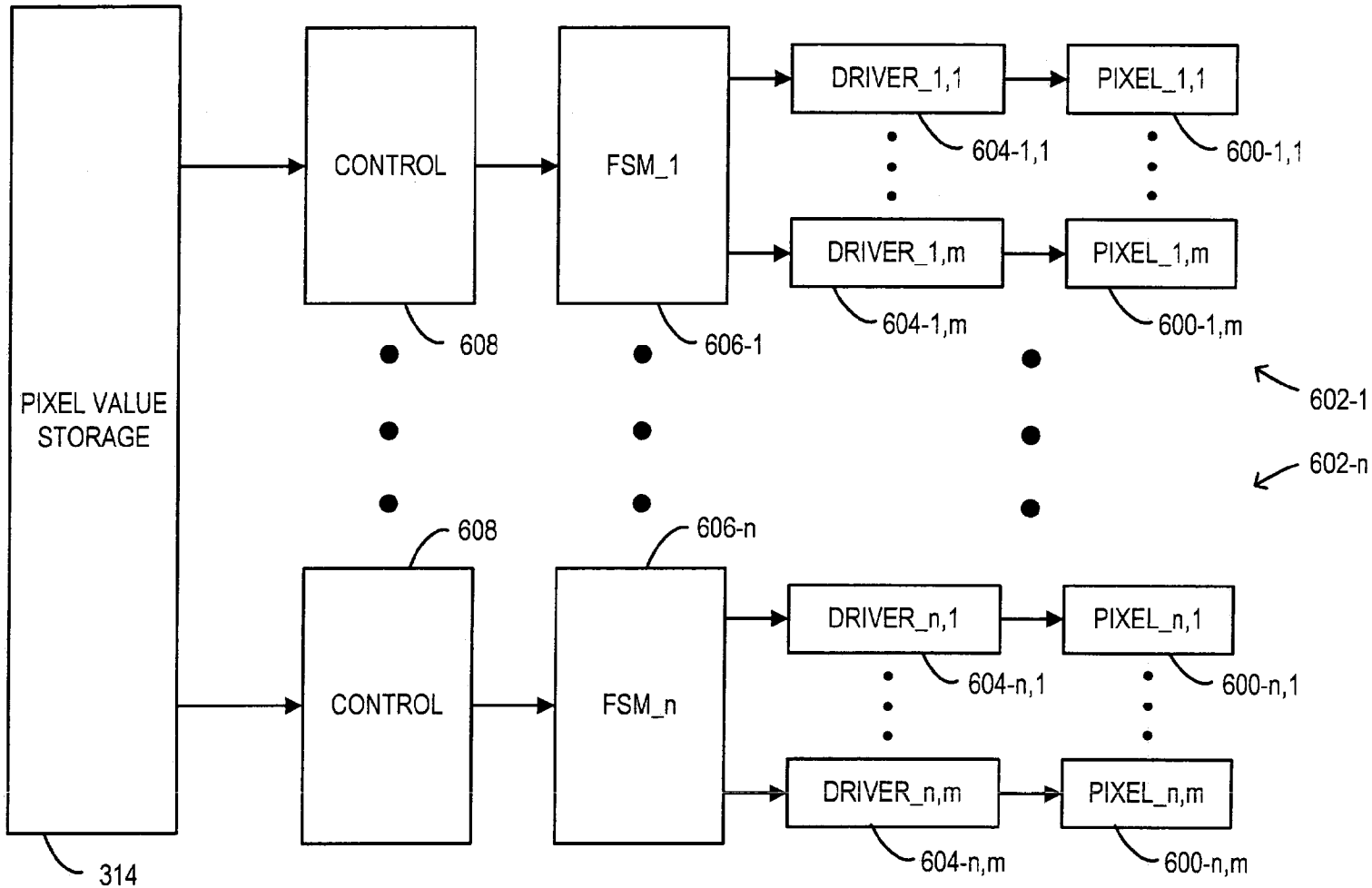
FIG. 6 is a block diagram similar to FIG. 3, but showing a pixel-driving arrangement according to some other embodiments.

In other embodiments, the array control and driving components 204 of the display device 100 may include an arrangement such as that shown in FIG. 6.

In FIG. 6, some or all of the pixels 600 making up the pixel array 104 are partitioned into n groups 602 consisting of m pixels each (the value of n indicated in FIG. 6 need not be the same as the value of n indicated in FIG. 3; the pixel indices indicated in the drawing need not correspond to positions of the pixels in the pixel array). Coupled to each pixel 600 is a driver 604 (which may be substantially the same as a driving circuit 306 shown in FIG. 3). All of the drivers 604 which correspond to the pixels 600 of each group 602 are coupled to, and controlled by, a respective finite state machine 606. The drivers 604 are configured to drive the pixels 600 in accordance with states of the state machines 606. Control circuits 608 are coupled to the finite state machines 606 and are configured to supply control signals to the finite state machines 606. The control circuits, in turn, are coupled to a pixel value storage circuit, which may be the same as the pixel value storage circuit 314 of FIG. 3.

Figure 7:
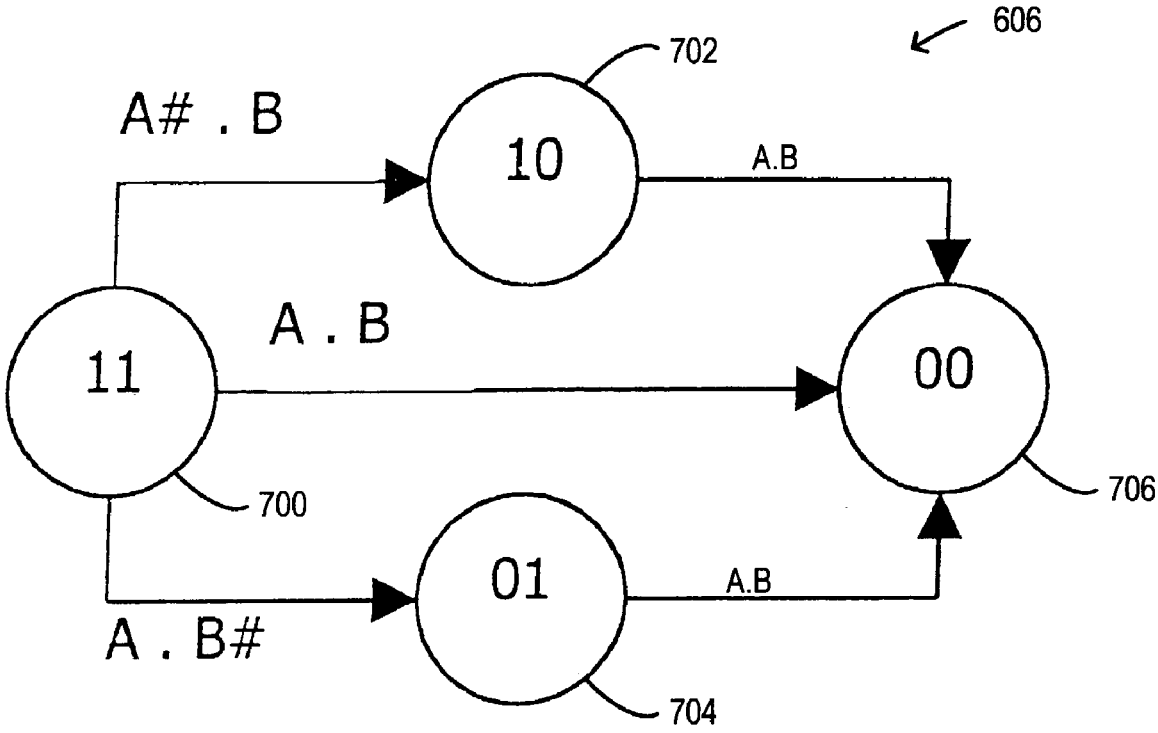
FIG. 7 is a state diagram that illustrates a typical one of finite state machines that are part of the pixel-driving arrangement of FIG. 6.

FIG. 7 is a state diagram that illustrates an example of how each of the finite state machines 606 may operate, assuming that two and only two pixels are included in each of the groups 602. The finite state machine 606 of FIG. 7 has four states 700, 702, 704 and 706. In some embodiments, the finite state machine has only these four states. In the first state 700, the finite state machine supplies control signals to the drivers for its group of pixels such that both pixels of the group are caused to be on. In the second state 702, the finite state machine supplies control signals to the drivers for its group of pixels such that a first one of the two pixels is caused to be off, and the other one (second one) of the two pixels is caused to be on. In the third state 704, the finite state machine supplies control signals to the drivers for its group of pixels such that the first one of the two pixels is caused to be on, and the second one of the two pixels is caused to be off. In the fourth state 706, the finite state machine supplies control signals to the drivers for its group of pixels such that both of the two pixels are caused to be off.

At the beginning of each sub-period, the finite state machine is initialized to its first state 700. If the finite state machine receives a first control signal ("A#.B") from its control circuit 608, the finite state machine transitions (changes state) from its first state 700 to its second state 702. If the finite state machine receives a second control signal ("A.B#") from its control circuit 608, the finite state machine transitions from its first state 700 to its third state 704. If the finite state machine receives a third control signal ("A.B") from its control circuit 608, the finite state machine transitions to its fourth state 706 from any one of its first state 700, its second state 702 and its third state 704, as the case may be.

The respective control circuit 608 for a particular finite state machine selects which of these control signals are provided to the finite state machine during the course of a particular sub-period, and selects the timings at which the control signals are provided to the finite state machine during the sub-period, on the basis of a plurality of pixel values (i.e. the respective pixel values for the pixels of the group controlled by the finite state machine) for the sub-period in question.

If the pixel values for the current sub-period indicate that the duration of the driving pulse for the first pixel is to be shorter than the duration of the driving pulse for the second pixel, then the control circuit 608 supplies the control signal "A#.B" to the finite state machine at a timing that corresponds to the end of the duration of the driving pulse for the first pixel. Later in the sub-period, the control circuit supplies the control signal "A.B" to the finite state machine at a timing that corresponds to the end of the duration of the driving pulse for the second pixel.

If the pixel values for the current sub-period indicate that the duration of the driving pulse for the second pixel is to be shorter than the duration of the driving pulse for the first pixel, then the control circuit supplies the control signal "A.B#" to the finite state machine at a timing that corresponds to the end of the duration of the driving pulse for the second pixel. Later in the sub-period, the control circuit supplies the control signal "A.B" to the finite state machine at a timing that corresponds to the end of the duration of the driving pulse for the first pixel.

If the pixel values for the current sub-period indicate that the respective driving pulses for the two pixels are to be the same, then the control circuit supplies the control signal "A.B" to the finite state machine at a timing that corresponds to the end of the duration of the driving pulses for the two pixels.

Operation of the arrangement of FIG. 6 in a typical sub-period, and in particular operation of just one of the finite state machines 606 and its associated control circuit 608, drivers 604 and pixels 600 will now be described. It will also be assumed that there are only two pixels in the group controlled by the finite state machine and that the finite state machine is arranged as illustrated in FIG. 7.

At the beginning of the sub-period, the finite state machine is initialized to its first state. (This may be done by a suitable control signal from the control circuit 608, or by a more global reset signal.) The finite state machine outputs signals that cause its two drivers 604 to turn on its two pixels 600. The control circuit compares the respective pixel values for the two pixels for this sub-period. It will be assumed that the pixel values indicate that the first pixel is to have an on-time that is shorter than the on-time for the second pixel. Therefore, at a timing that corresponds to the end of the on-time for the first pixel, the control circuit supplies to the finite state machine the control signal "A#.B". In response to this signal, the finite state machine transitions from its first state 700 (FIG. 7) to its second state 702. The signals output from the finite state machine change so that the driver for the first pixel changes state and deactuates the first pixel. The second pixel remains on. Then, at a timing that corresponds to the end of the on-time for the second pixel, the control circuit supplies to the finite state machine the control signal "A.B". In response to this signal, the finite state machine transitions from its second state 702 to its fourth state 704. The signals output from the finite state machine change so that the driver for the second pixel changes state and deactuates the second pixel. The first pixel remains off. At the end of the proper time, the sub-period terminates.

The arrangement of FIG. 6 may be advantageous in that a single circuit is provided to control a group of pixels. This may allow for a reduction in the complexity of circuitry used to control the pixels of the pixel array.

The finite state machines of FIG. 6 have been illustrated with an example in which each finite state machine controls a group consisting of two pixels. Alternatively, each finite state machine may be arranged to control three, four or more pixels. Thus each group of pixels may include more than two pixels.

Instead of the separate control circuits 608, each of which is associated with a respective finite state machine 606, the control circuits may be combined so as to control two or more, or all, of the finite state machines. Also, instead of having a single pixel value storage circuit 314, the function of storing the pixel values may be divided up among a number of storage devices.

The embodiments described above have been concerned with liquid crystal on silicon (LCOS) display devices. However, the pixel driving arrangements described herein are also applicable to other types of display devices, such as so-called digital light processors (DLPs) in which a respective mirror corresponds to each pixel, and the mirrors are moved to actuate or deactuate the pixels.

The several embodiments described herein are solely for the purpose of illustration. The various features described herein need not all be used together, and any one or more of those features may be incorporated in a single embodiment. Therefore, persons skilled in the art will recognize from this description that other embodiments may be practiced with various modifications and alterations.

What is claimed is:

1. An apparatus comprising:

a first pixel;

a second pixel;

a counter;

a first driver coupled to the counter and to the first pixel, and configured to drive the first pixel in accordance with a first pulse width that corresponds to a value stored in the counter, the first driver including a first comparator coupled to the counter and configured to compare a current counter value with zero;

a register;

a second driver coupled to the counter, to the register, and to the second pixel and configured to drive the second pixel in accordance with a second pulse width that is determined based on (a) the value stored in the counter, and (b) a value stored in the register, the second driver including a second comparator coupled to the counter and the register, the second comparator being configured to compare the current counter value with the value stored in the register;

a storage device which stores a first pixel value and a second pixel value; and a control circuit coupled to the storage device, to the counter, and to the register;

the control circuit being configured to:

initialize the counter to the first pixel value;

calculate a difference between the first pixel value and the second pixel value; and store a value corresponding to the calculated difference in the register.

2. The apparatus of claim 1, further comprising:

a liquid crystal material associated with the pixels.

3. An apparatus comprising:

a source of image data; and a display device coupled to the source of image data, the display device including:

a first pixel;

a second pixel;

a counter;

a first driver coupled to the counter and to the first pixel, and configured to drive the first pixel in accordance with a first pulse width that corresponds to a value stored in the counter, the first driver including a first comparator coupled to the counter and configured to compare a current counter value with zero;

a register;

a second driver coupled to the counter, to the register, and to the second pixel and configured to drive the second pixel in accordance with a second pulse width that is determined based on (a) the value stored in the counter, and (b) a value stored in the register, the second driver including a second comparator coupled to the counter and the register, the second comparator being configured to compare the current counter value with the value stored in the register;

a storage device which stores a first pixel value and a second pixel value; and a control circuit coupled to the storage device, to the counter, and to the register;

the control circuit being configured to:

initialize the counter to the first pixel value; and calculate a difference between the first pixel value and the second pixel value; and store a value corresponding to the calculated difference in the register;

the first and second pixel values being based on the image data.

4. The apparatus of claim 3, wherein the display device further includes:

a liquid crystal material associated with the pixels.

* * * * *